United States Patent [19]

Jimenez

[11] Patent Number: 5,072,762

[45] Date of Patent: Dec. 17, 1991

[54] SEAL PUNCTURE FITTING ON A LIQUID CONTAINER

[76] Inventor: Jesus Jimenez, 15390 SW. 269th Ter., Homestead, Fla. 33032

[21] Appl. No.: 541,334

[22] Filed: Jun. 21, 1990

[51] Int. Cl.[5] ..... B65D 41/36

[52] U.S. Cl. ..... 141/329; 141/319; 141/330; 141/363; 141/320; 222/83; 184/1.005; 215/100 R

[58] Field of Search ..... 141/312, 319, 330, 326, 141/329, 363, 364, 365, 366, 320, 321; 222/81, 83, 89, 90; 184/1.5, 105.1; 215/100 R, 250, 257

[56] References Cited

U.S. PATENT DOCUMENTS

| | | | |
|---|---|---|---|
| 3,094,155 | 6/1963 | Taramosso et al. | 222/83 |
| 3,186,450 | 6/1965 | Beall et al. | 141/319 |
| 4,485,932 | 12/1984 | Kusz | 215/332 |
| 4,722,449 | 2/1988 | Dubach | 222/83 |
| 4,898,293 | 2/1990 | Morel | 222/83 |

*Primary Examiner*—Ernest G. Cusick

*Attorney, Agent, or Firm*—Malloy, Downey & Malloy

[57] ABSTRACT

A seal puncture fitting mounted to the distal end of a spout of a liquid container including a cylindrical collar disposed about the spout in telescopic relation thereto wherein the collar is attached to the spout by a cam structure designed to allow both rotational and vertical movement of the collar in relation to the spout. A cutting blade is disposed within the collar at an upper end thereof, such that downward vertical movement of the collar causes the cutting blade to puncture a membrane seal disposed in covering, sealed relation to the spout opening. The upper portion of the collar includes a threaded outer surface for threaded engagement of a cap thereby preventing liquid from spilling between each use.

6 Claims, 3 Drawing Sheets

SEAL PUNCTURE FITTING ON A LIQUID CONTAINER

BACKGROUND OF THE INVENTION

1. Field of the Invention

The present invention relates generally to closures for liquid containers having a membrane seal disposed in sealed relation to a spout opening and more particularly, to a closure fitting adapted to puncture the foil membrane seal of a conventional plastic bottle containing motor oil or like substances.

2. Description of the Prior Art

Plastic bottles containing poisonous or otherwise dangerous liquids are frequently provided with a membrane seal generally formed of foil or plastic material. In particular, motor oil has recently been packaged in plastic bottles having a foil membrane seal disposed in covering relation to a spout opening. The spout on most of these oil bottles includes a neck extending from the body of the bottle wherein the diameter of the neck is specifically adapted to fit within the oil filling aperture of a typical automobile oil casing such that the oil may be conveniently transferred from the bottle to the car's engine. However, there are several problems associated with the sealed plastic bottles in the present art. One such problem is that once the foil seal has been manually pierced or removed, the bottle must be inverted 180° so that the neck of the bottle can be inserted within the filling aperture of the automobile oil casing. This procedure often results in at least partial spillage of the oil on the exterior engine parts as the user tries to quickly insert the neck within the filling aperture. To remedy this problem, some individuals using these plastic oil bottles attempt to keep their thumb or finger over the spout opening of the bottle until just before the bottle neck can be inserted within the filling aperture. Alternatively, others have attempted to quickly invert the bottle while holding it immediately above the filling aperture so that the bottle neck can be inserted before any oil begins to flow from the bottle. However, these methods have proven to be unsuccessful in the past, often resulting in oil contaminating the user's fingers and hands or resulting in even greater spillage of the oil contents on the car and ground, if, in a desperate movement, the person misses the filling aperture of the oil casing.

The present invention provides a new and useful closure assembly for motor oil bottles or like liquid containers wherein the foil membrane seal remains unpunctured until after the bottle has been completely inverted and inserted within the filling aperture, at which time, a downward force on the bottle causes the filling aperture to be punctured, thereby solving the long standing problem associated with the prior art.

SUMMARY OF THE INVENTION

In accordance with the present invention, a two piece closure assembly is provided comprising a collar member and a screw-on cap. The cylindrical collar member includes a triangular blade disposed within its interior core. The collar member surrounds the neck portion on the bottle and extends upwardly beyond the open end having the seal attached thereto. The collar member is attached to the bottleneck by means of a cam structure which permits both sliding, telescopic movement of the collar as well as rotational movement of the collar about the neck of the bottle. The cam structure includes a notched track disposed about the outer surface of the bottle's neck whereby a knob formed on the inner surface of the collar member is specifically structured to fit within the notched track. The cam fitted within the notched track acts to both attach the collar to the bottle's neck as well as initially limiting movement of the collar to a stepped rotational movement about the bottle's neck. The notched track terminates at one end into a vertically extending straight groove such that when the cam becomes aligned with the vertical groove, the entire collar can slide downwardly along the length of the neck of the bottle, thereby causing an apex of the triangular blade to puncture the foil membrane seal. The aforementioned screw-on cap is adapted to threadably engage with an outer threaded surface on the upper end of the cylindrical collar member.

In use, the screw-on cap would first be removed from the upper end of the collar portion before inserting the entire closure assembly, including the collar member and bottle neck, within the filling aperture on the automobile oil casing. With the cap removed, the collar portion is rotated until the cam becomes aligned with the vertically extending groove. At this time, the bottle can be inverted and the closure assembly inserted within the filling aperture until a pair of outwardly extending wing portions on the collar engage the outer surface of the oil casing surrounding the filling aperture. Upon forcing the oil bottle downward towards the filling aperture, engagement of the wings against the oil casing forces the collar member to move along the length of the neck portion until the triangular blade punctures the seal thereby permitting the contents of the bottle to flow therefrom into the engine without any spillage or contamination. If the entire contents of the bottle are not exhausted, the screw-on cap may be replaced on the upper end of the collar member so that the contents may safely stored for future use.

It is, therefore, an important object of the present invention to provide a closure assembly for a liquid container having a membrane seal such that the seal may be pierced or broken after the liquid container has been inverted and positioned before the liquid contents begin to dispense.

Another object of the invention is to provide a device as stated above, in which the spillage or contamination problems associated with the prior art are eliminated.

Another object of the invention is to provide a closure and puncturing assembly for attachment to the distal end of the spout or neck of a plastic motor oil bottle such that the foil membrane seal can be punctured once having inserted the bottle spout within the filling aperture of an automobile.

A further object of the present invention lies in the provision of a closure assembly for a sealed liquid container which can be easily and economically manufactured.

A still further object of the present invention is to provide a closure assembly for a motor oil type bottle which not only provides a means for piercing a foil membrane seal but additionally allows for safe storage of unused contents.

Further objects and advantages of the present invention will be apparent from the following description of the invention.

The invention accordingly comprises the features of construction, combination of elements and arrangement of parts which will be exemplified in the construction hereinafter set forth and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
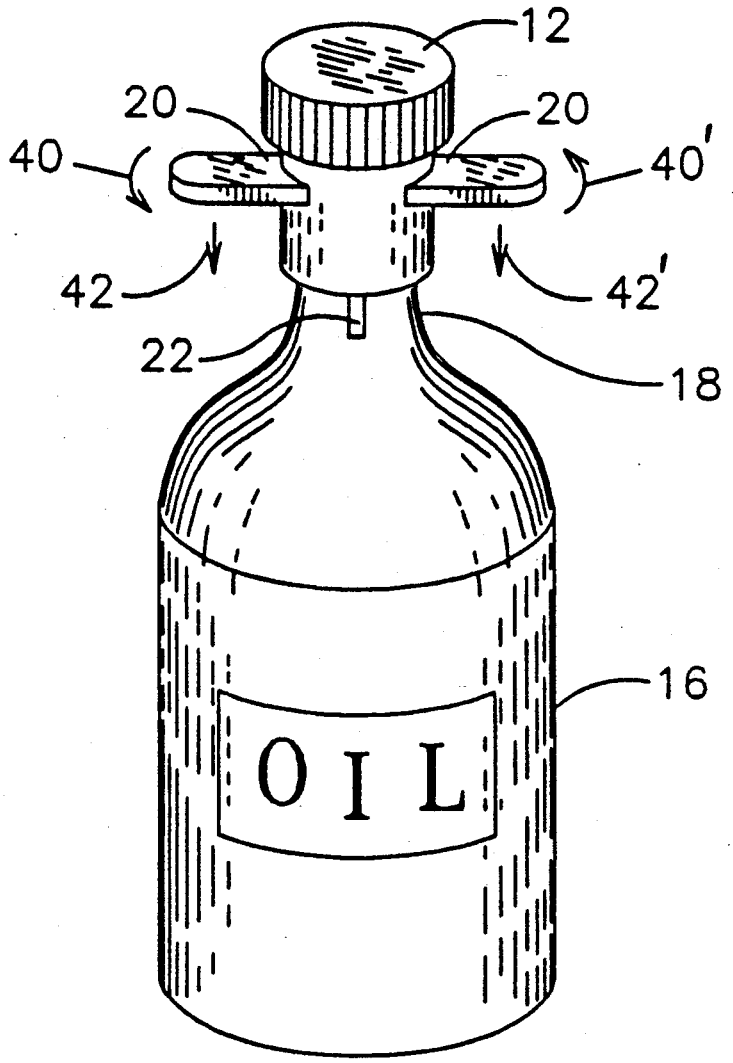
FIG. 1 is a perspective view showing the novel closure arrangement of the present invention on a conventional motor oil bottle.
Figure 2:
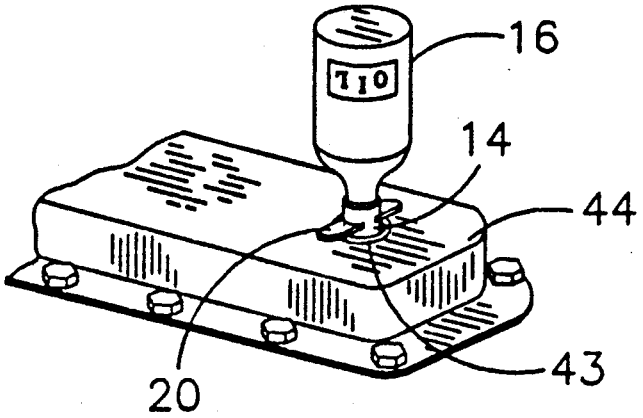
FIG. 2 illustrates a motor oil bottle inserted within the oil filling aperture of an automobile oil casing wherein the cylindrical collar member is shown in use.
Figure 3:
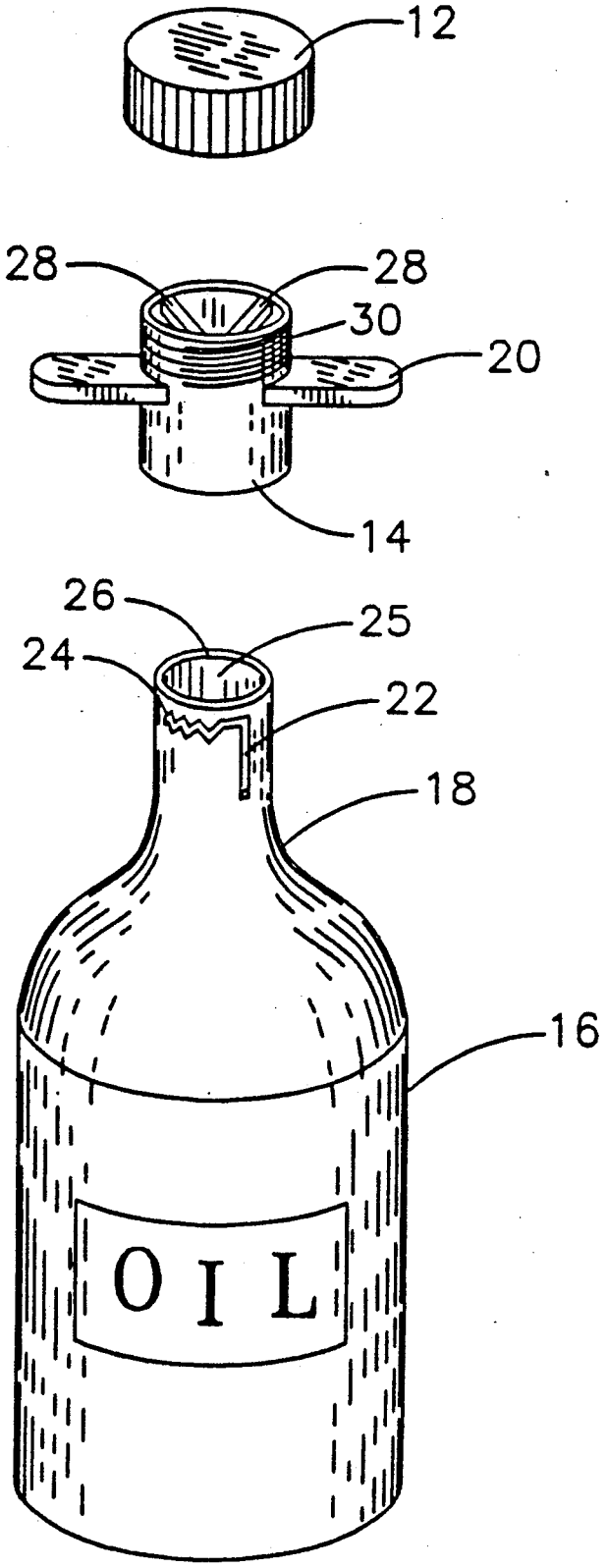
FIG. 3 is an exploded view of FIG. 1 showing the cap, collar member, and bottle in detail.
Figure 4:
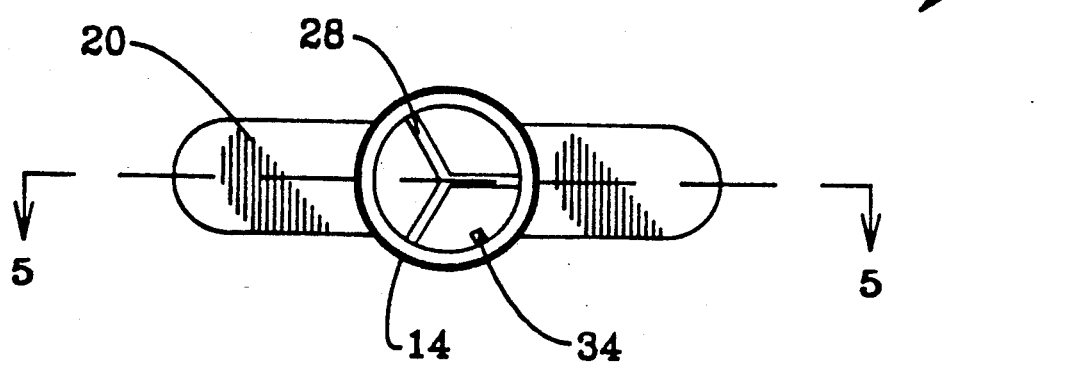
FIG. 4 is a top view in cross-section of the cylindrical collar member.
Figure 5:
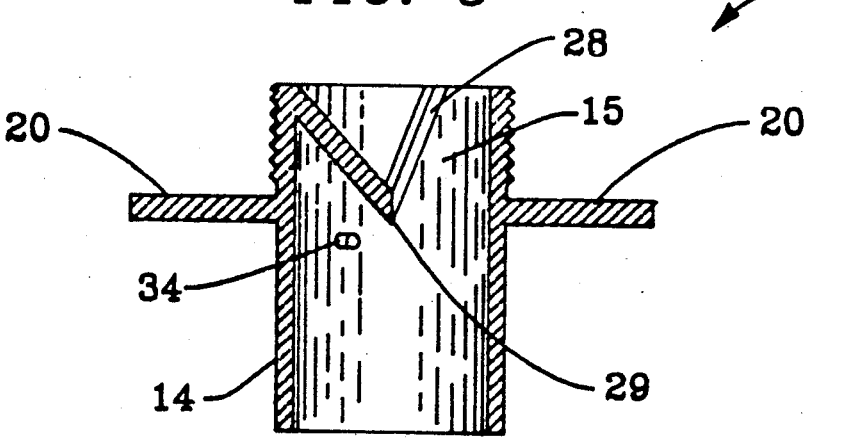
FIG. 5 is a sectional view taken along line 5—5 of FIG. 4.
Figure 6:
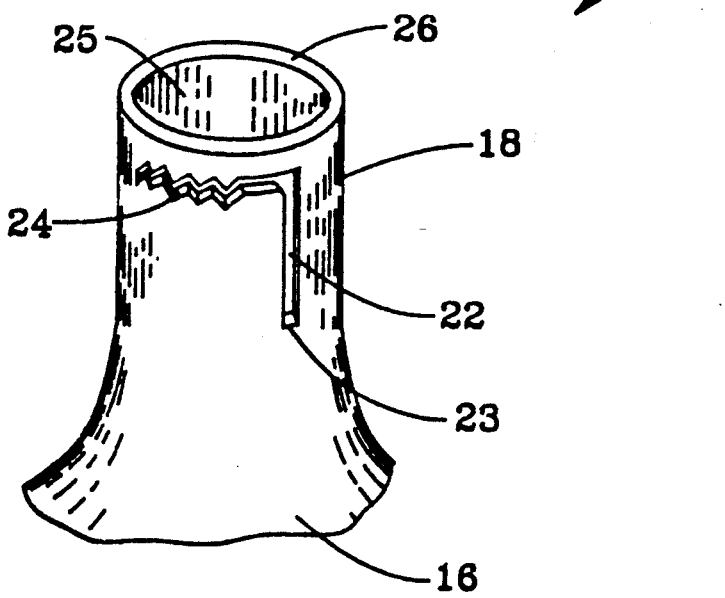
FIG. 6 is a perspective view of the upper neck and spout opening of the bottle displaying the notched cam track and vertically extending groove.

With reference to FIG. 1, there is generally shown the closure and seal puncturing assembly 10 of the present invention mounted to the distal end of the neck portion of a conventional motor oil bottle 16. The closure and seal puncturing assembly 10 includes a cap 12 and a cylindrical collar member 14. The closure and seal puncturing assembly may be formed of any material suitable for its intended use, but is preferably of a synthetic plastic composition.

The cap 12 is preferably internally threaded for cooperative, threaded engagement with an external threaded portion 30 on the upper external surface of the collar member 14. The threaded engagement of the cap 12 on the distal end of the collar 14 allows for reclosure of the bottle 16 after the seal 25 has been punctured, thereby creating a means for storage of any unused contents of the bottle.

With reference to FIGS. 3 through 6, a preferred embodiment of the present invention includes the cylindrical collar member 14 and the bottle 16 including individual components adapted for cooperative engagement with one another. Specifically, a cutting means 28, preferably in the form of a triangular shaped blade, including a cutting apex 29, is disposed on the interior portion 15 of the hollow cylindrical collar. The cutting means 28 is disposed within the cylindrical collar 14 such that the cutting apex 29 is oriented slightly above the foil membrane seal 25 of the bottle 16 when the cylindrical collar member 14 is disposed in a normally extended position wherein a portion of the cylindrical collar extends beyond a distal end 26 of the bottle's neck 18.

Along the interior wall 15 of the collar 14, at approximately the collar's mid-section, a cam 34 is dimensioned and oriented such that the cam 34 fits within the cam track 24 disposed on the outer peripheral surface of the neck 18 of the bottle 16. The cam track 24 includes a notched portion extending partially about the outer circumference of the neck 18 such that as the collar 14 is rotated, a ratchet effect is achieved. The collar 14 may be rotated until the cam 34 becomes aligned with a vertically extending groove 22 of the cam track disposed at one end of the notched portion. When the cam 34 becomes aligned with the vertical groove 22, pressure is applied to the outwardly extending levers 20 on the collar 14, such that the cam 34 travels down the vertical groove 22 to its terminal end 23, thereby allowing the triangular cutting blade to puncture the seal 25. Thereafter, the liquid contents of the bottle 16 can readily flow from the container into the oil casing.

The operation of the device is illustrated in FIG. 1 wherein directional arrows 40 and 40′ indicate rotational movement of the collar 14 about the neck 18 of the bottle 16. Additionally, directional arrows 42 and 42′ indicate the downward movement of the collar portion 14 once the cam is in line with the vertical groove 22.

Accordingly, the invention as illustrated and described is not to be limited to the details of the preferred embodiments, rather, it is clearly understood that various changes in detail or other modifications may be made without departing from the spirit and scope of this disclosure.

Now that the invention has been described, What is claimed is:

1. A combination liquid container and seal puncture assembly, the liquid container having a spout with a membrane seal disposed in covering, sealed relation over a top opening of the spout, said combination liquid container and seal puncture assembly comprising:

a cylindrical collar member adapted to fit telescopically about the spout of the container so at to be movable from a normally extended position to a collapsed position, said cylindrical collar member being disposed about the spout of the container with an upper portion of said cylindrical collar member extending beyond the top opening of the spout, defining said normally extended position, a cutting means disposed within said upper portion of said cylindrical collar member and structured and configured to pierce and pry open the membrane seal covering the top opening of the spout upon telescopic movement of said cylindrical collar member to said collapsed position, a cam means attaching said cylindrical collar member to the spout, said cam means dimensioned and disposed to allow for both rotational and vertical movement of said cylindrical collar member about the spout of the container, said cam means including a notched cam track disposed circumferentially about the spout, said cam means further including a cam disposed on an inner surface of said cylindrical collar member and adapted to be receivingly engaged within said notched cam track on the spout so as to permit said rotational movement of said collar member about the spout, said cam means further including a vertical groove interconnecting with an extending downwardly with said notched cam track and structured and configured to allow said cam to travel therealong permitting said vertical movement of said collar member from said normally extended position to said collapsed position, said cylindrical collar member including a threaded outer surface disposed about an upper end thereof, and a cap means for covering said upper end of said cylindrical collar member and including an annular lip having a threaded inner surface adapted for threadable engagement with said threaded outer surface of said cylindrical collar member.

2. An assembly as in claim 1 wherein said vertical movement of said collar member to said collapsed position causes said cutting apex of said triangular cutting blade to pierce the seal on the spout opening.

3. An assembly as in claim 2 wherein said collar member further includes at least one outwardly extending lever structured and configured to engage a surrounding surface of an aperture formed in a liquid receiving chamber.

4. An assembly as in claim 3 wherein said liquid receiving chamber is an oil casing of an automobile engine.

5. An assembly as in claim 4 wherein said collar member includes two oppositely disposed outwardly extending levers adapted to engage said surface surrounding said aperture of said liquid receiving chamber.

6. An assembly as in claim 1 wherein said cutting means includes a triangular blade including a cutting apex normally disposed in spaced relation above the seal on the spout when said cylindrical collar member is in said extended position.

* * * * *